United States Patent [19]

Katzman et al.

[11] 4,240,224

[45] Dec. 23, 1980

[54] TOY VEHICLE

[75] Inventors: Allison W. Katzman, Chicago; Burton C. Meyer, Downers Grove; Erick E. Erickson, Chicago; Palmer J. Schoenfield, Evanston, all of Ill.

[73] Assignee: Marvin Glass & Associates, Chicago, Ill.

[21] Appl. No.: 974,309

[22] Filed: Dec. 29, 1978

[51] Int. Cl.[3] ..... A63H 3/06

[52] U.S. Cl. ..... 46/88; 46/44; 46/90; 46/106

[58] Field of Search ..... 46/44, 87, 88, 89, 106, 46/202, 201, 135 R, 90; 40/412

[56] References Cited

U.S. PATENT DOCUMENTS

| | | | |
|---|---|---|---|
| 494,410 | 3/1893 | Carpenter | 46/135 R UX |
| 1,098,303 | 5/1914 | Steiner et al. | 46/88 |
| 1,710,918 | 4/1929 | Carlsen | 46/89 |
| 1,765,435 | 6/1930 | McBride | 46/89 |
| 2,348,250 | 5/1944 | Gardner et al. | 40/412 X |
| 2,364,427 | 12/1944 | Davidson | 46/89 |
| 2,565,679 | 8/1951 | Dunn et al. | 46/90 |
| 2,608,695 | 9/1952 | Marcell | 46/90 |
| 2,668,394 | 2/1954 | Auzin | 46/135 R |
| 3,232,001 | 2/1966 | Stanzel | 46/89 X |
| 3,346,989 | 10/1967 | Ryan et al. | 46/44 |

*Primary Examiner*—F. Barry Shay

*Attorney, Agent, or Firm*—Mason, Kolehmainen, Rathburn & Wyss

[57] ABSTRACT

The present invention provides an inflatable toy vehicle including a main housing or chassis supported by a plurality of rotatably mounted wheels for peripherally engaging a suitable surface. A rear cargo portion includes a plurality of apertures or windows and encloses a flexible, inflatable sack. Collapsible portions of the sack adjacent the windows are decorated and formed to appear as animal heads so that internal pressure will cause the formed portions to expand outwardly and take the predetermined shape. A pump in the form of a bellows is provided in the front portion or cab of the vehicle and operated by manually reciprocating a figure mounted on the top thereof for inflating the sack.

3 Claims, 5 Drawing Figures

TOY VEHICLE

BACKGROUND OF THE INVENTION (1) Field of the Invention

The present invention relates to inflatable toys and vehicles and in particular to a wheeled vehicle including an inflatable inner sack having a plurality of protruding portions, each designed to appear as an animal head and means for inflating the pneumatic sack.

(2) Description of the Prior Art

Many toy vehicles have been proposed which are designed to resemble their real life counterpart. Examples of these include fire trucks, mail trucks, race cars and the like. Other examples are shown in the prior patented art such as R. G. Baulard-Cogan U.S. Pat. No. 3,153,881 issued Oct. 27, 1964, and H. M. Westcott U.S. Pat. No. 2,559,909 issued July 10, 1951 and D. G. Rempel U.S. Pat. No. 2,631,407 issued Mar. 17, 1953.

SUMMARY OF THE INVENTION

The present invention provides a new toy vehicle having the appearance of an animal wagon as would be used by a circus. The present invention provides a toy vehicle including a main housing, wheels for peripherally engaging a supporting surface, an inflatable sack having a plurality of protruding portions decorated and formed to appear as an animate head and a bellows pump for inflating the pneumatic sack. The main housing includes a rear cargo portion enclosing the pneumatic sack and a front cab portion housing the bellows pump. The rear cargo portion of the body includes six apertures through which protruding portions of the inflated sack may extend outwardly when in the inflated state. The front cab portion includes one aperture through which the top of the bellows pump extends so as to allow the bellows pump to be operable to inflate the sack.

It is an object of the present invention to provide a new and improved inflatable toy vehicle which will provide hours of entertainment for the child.

DESCRIPTION OF THE PREFERRED EMBODIMENT

Figure 2:
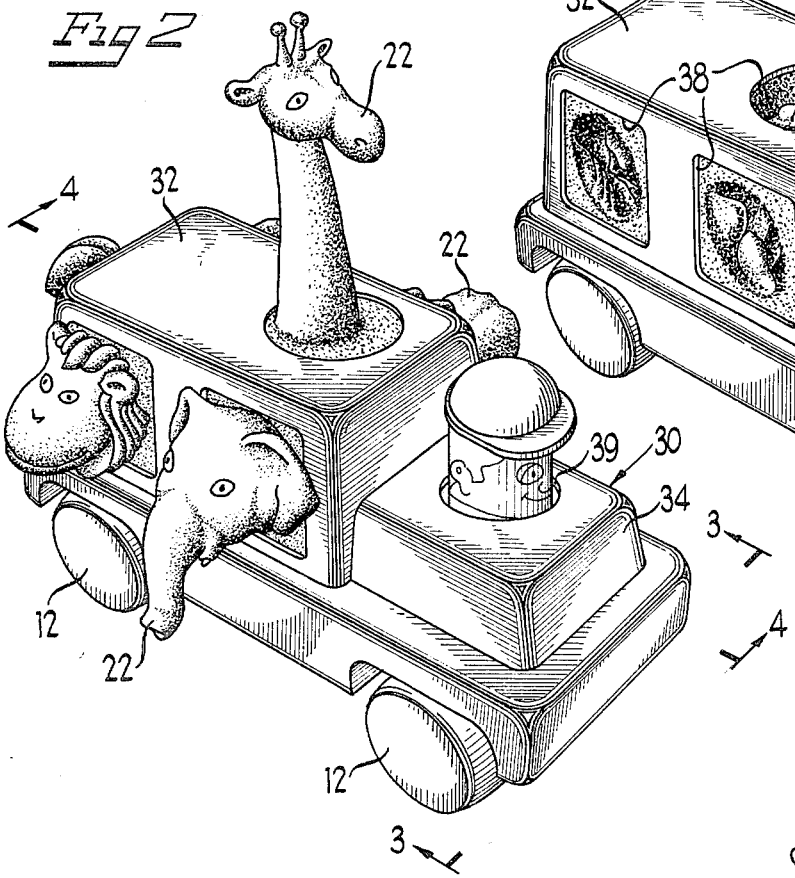
FIG. 2 is another perspective view of the apparatus in FIG. 1 showing the device in its inflated state.
Figure 1:
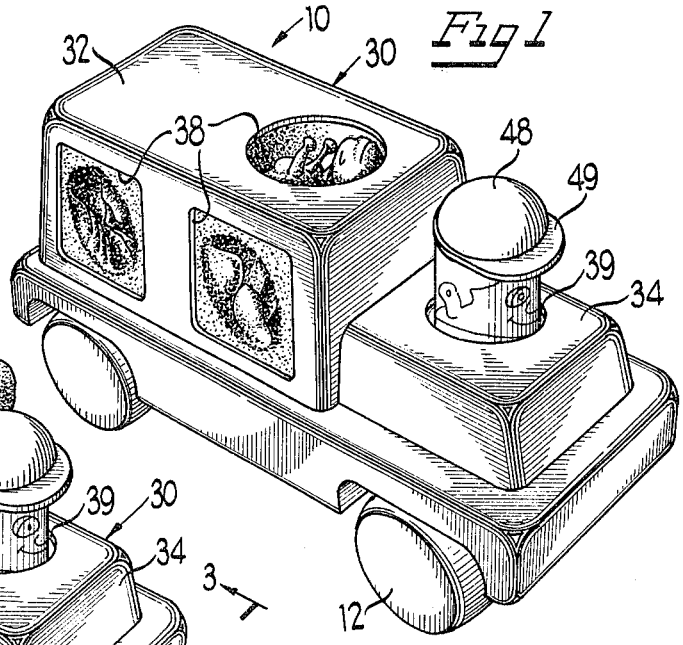
FIG. 1 is a perspective view of the inflatable toy vehicle of the present invention.

The inflatable toy vehicle 10 of the present invention includes a generally hollow rectangular vehicle frame 30 having a rear chamber or cargo portion 32 and a frontal chamber or cab portion 34 mounted thereon. The frame 30 also includes a plurality of bearings 36 in which are journalled two axles 13. The rear chamber 32 includes generally square or circular windows or six apertures 38 as seen in FIG. 1. The front chamber 34 includes one aperture 39 located on the top of the cab portion 34.

Figure 4:
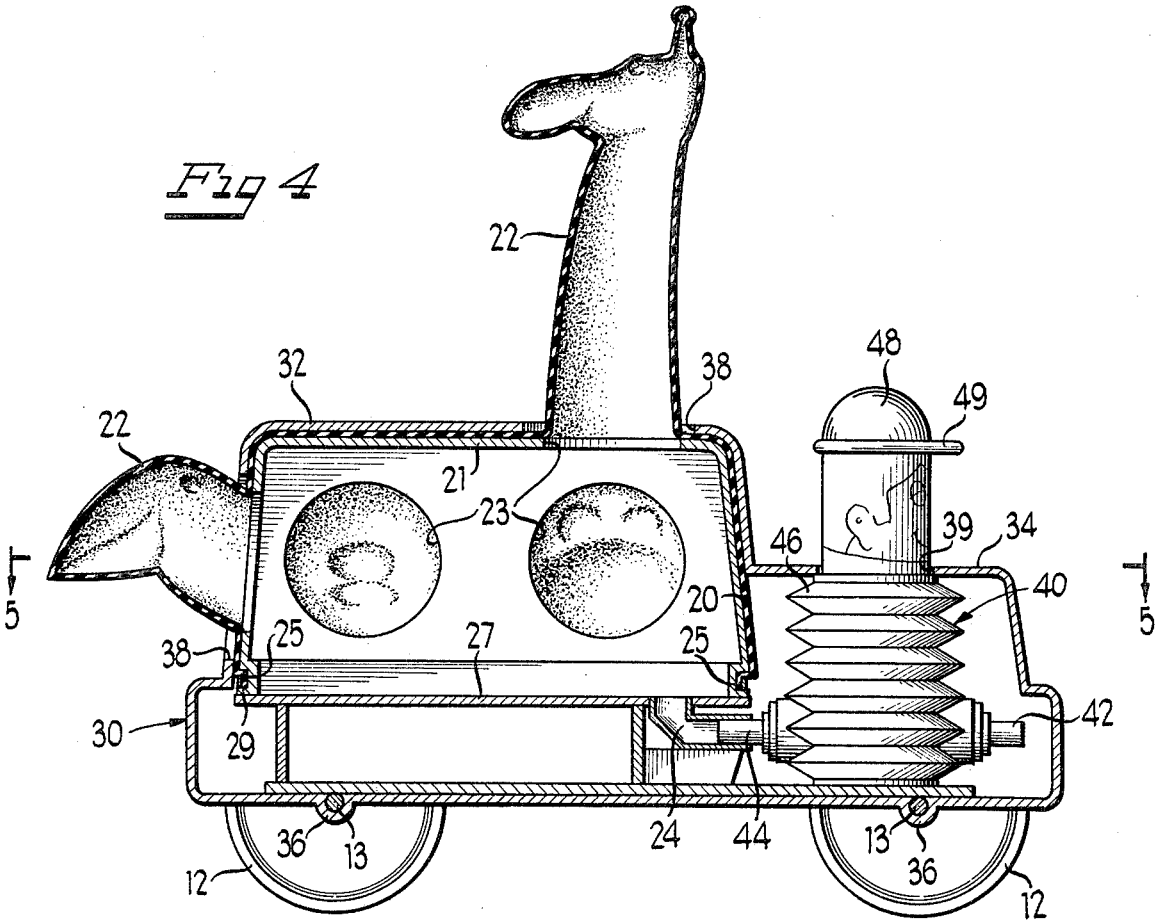
FIG. 4 is a partial section taken generally along line 4—4 of FIG. 2.
Figure 5:
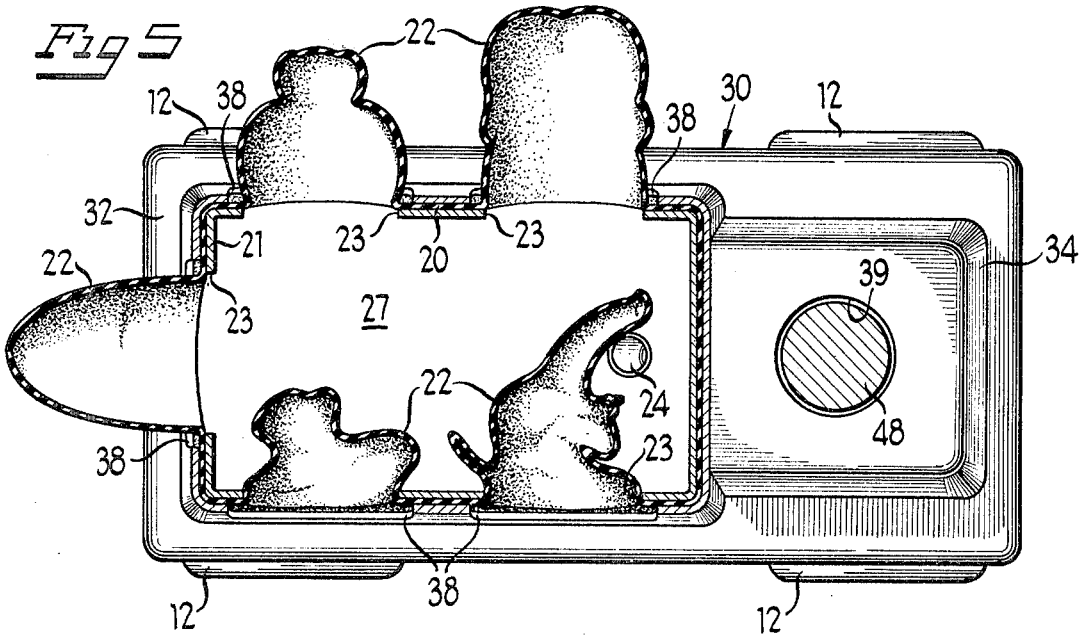
FIG. 5 is a partial section taken generally along line 5—5 of FIG. 4.

Referring particularly to FIGS. 4 and 5, the invention as contemplated, includes a generally hollow inflatable sack 20 which fits into the rear chamber 32 and substantially in contact with the entire interior thereof. The pneumatic sack includes a plurality of formed portions 22 which are constructed of a generally pliable material and may be pushed inwardly as shown in the bottom of FIG. 5. The formed portions 22 may be forced outwardly as illustrated in FIGS. 4 and 5 by generating pressure within the sack as described below. The sack is sandwiched between the outer wall of the chamber 32 and an inner skeletal wall 21 having similarly aligned apertures 23. A grove 25 at the bottom of the wall 21 maintains an air tight seal with a bottom plate 27. The inflatable sack 20 is generally deformable and may be formed of a suitable material such as plastic or rubber. The sack 20 is open at the bottom and includes a ridge 29 which fits into the grove 25 for easy assembly.

FIG. 4 illustrates a depending nipple 24 on the bottom of the plate 27 communicating with the interior of the sack 20. The depending nipple 24 is constructed of a generally hardened plastic or other suitable material, so that it might act as a collar for receiving a smaller nipple from a bellows pump 40 thereby allowing compressed air to pass into the inflatable sack 20.

Figure 3:
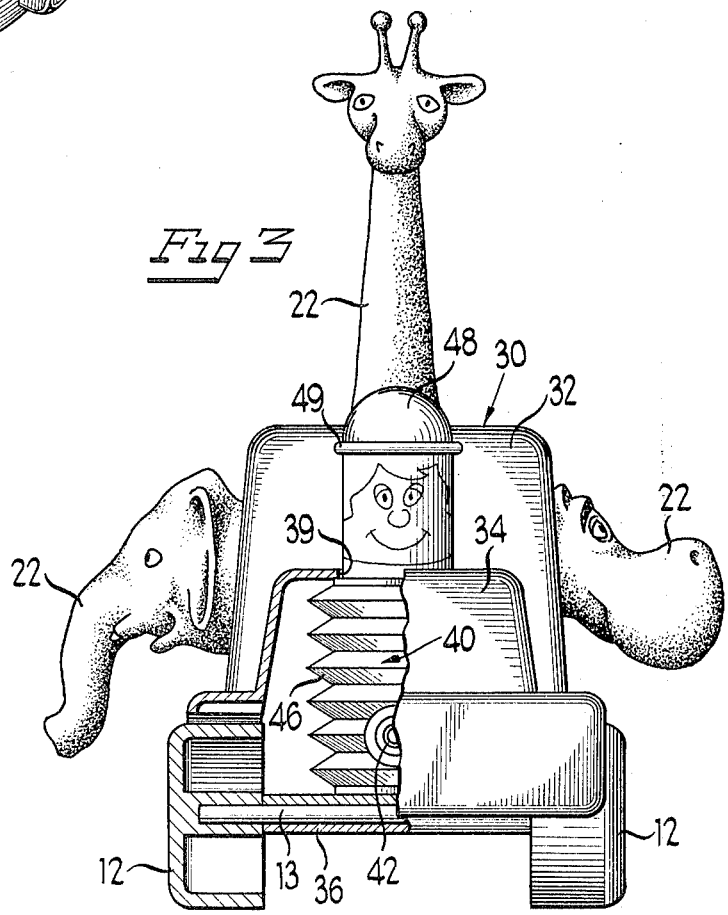
FIG. 3 is a partial section taken generally along line 3—3 of FIG. 2.

FIGS. 3 and 4 accurately illustrate the location of a bellows pump generally designated 40 within the cab portion 34. The bellows pump is constructed having an inlet 42, and outlet 44, which communicates with the depending nipple 24, an accordion structure 46, a top figure 48 designed to appear as the head of a driver, and a flanged lip 49 designed to stop the movement of the top 48 through the aperture 39. A check valve (not shown) permits one direction of air flow into the sack. The bellows pump 40 may be reciprocated between up and down positions so as to inflate the sack 20 thereby forcing the formed portions 22 out of the apertures 38. After leakage of the air from the sack 20, the formed portions 22 may then be depressed and pushed inwardly into the rear chamber 32 thereby allowing for replication of the entire procedure providing hours of entertainment for the child.

The toy vehicle 10 as shown in the drawings, includes four wheels 12 which are mounted upon axles 13 journalled in bearings 36. The formed portions 22 are designed to represent the neck and head portions of a giraffe, elephant, hippopotamus, lion or other circus or zoo animals.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent is:

1. A circus truck toy, comprising:

a vehicle frame supported by wheel means for rolling support on a suitable surface;

a rear cargo portion;

a front cab portion;

a plurality of windows in the rear cargo portion;

a flexible pneumatic sack mounted within the cargo portion, said flexible sack having a plurality of protruding portions aligned with the windows to permit the same extend outwardly upon inflation thereof;

means for giving each one of said extended protrusions the shape and appearance of an animal; and means for pressurizing said sack.

2. The circus truck toy of claim 1, wherein the means for inflating the pneumatic sack comprises a bellows pump and valve means.

3. A toy vehicle, including:

a vehicle frame including wheel means mounted on the frame for peripherally engaging a suitable surface and rollingly supporting the vehicle for travel thereover, said frame including a generally hollow rigid housing structure having at least one window;

a pneumatic sack within said housing having at least one portion capable of extending through said window and being decorated and formed to appear as a portion of an animate body; and a selectively operable pump for inflating the pneumatic sack to cause the extendable portion to protrude through said window, said frame including a front cab portion for enclosing the pump, said cab having an opening in the top thereof and a toy figure extending therethrough, said toy figure being reciprocally movable to operate the pump.

* * * * *